US007590525B2

(12) United States Patent
Chen

(10) Patent No.: US 7,590,525 B2
(45) Date of Patent: Sep. 15, 2009

(54) FRAME ERASURE CONCEALMENT FOR PREDICTIVE SPEECH CODING BASED ON EXTRAPOLATION OF SPEECH WAVEFORM

(75) Inventor: Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 620 days.

(21) Appl. No.: 10/222,934

(22) Filed: Aug. 19, 2002

(65) Prior Publication Data

US 2003/0078769 A1 Apr. 24, 2003

Related U.S. Application Data

(60) Provisional application No. 60/344,374, filed on Jan. 4, 2002, provisional application No. 60/312,789, filed on Aug. 17, 2001.

(51) Int. Cl.
*G10L 19/14* (2006.01)

(52) U.S. Cl. ..... 704/211; 704/220; 704/216

(58) Field of Classification Search ..... 704/223, 704/228, 219, 220, 221, 222, 230, 500–504, 704/211, 207, 216, 217
See application file for complete search history.

(56) References Cited

U.S. PATENT DOCUMENTS 5,615,298 A 3/1997 Chen ..... 395/2.37
5,699,485 A 12/1997 Shoham
6,085,158 A 7/2000 Naka et al.
6,188,980 B1 2/2001 Thyssen
2003/0078769 A1 * 4/2003 Chen ..... 704/211

FOREIGN PATENT DOCUMENTS

EP 0 747 882 A2 12/1996
WO WO 99/66494 12/1999

OTHER PUBLICATIONS

Kim, Hong K., "A Frame Erasure Concealment Algorithm Based on Gain Parameter Re-estimation for CELP Coders," Sep. 2001, IEEE Signal Processing Letters, vol. 8, No. 9, pp. 252-256.*

(Continued)

*Primary Examiner*—Huyen X. Vo
(74) *Attorney, Agent, or Firm*—Sterne, Kessler, Goldstein & Fox, PLLC

(57) ABSTRACT

A method and system are provided for synthesizing a number of corrupted frames output from a decoder including one or more predictive filters. The corrupted frames are representative of one segment of a decoded signal (sq(n)) output from the decoder. The method comprises determining a first preliminary time lag (ppfe1) based upon examining a predetermined number (K) of samples of another segment of the decoded signal and determining a scaling factor (ptfe) associated with the examined number (K) of samples when the first preliminary time lag (ppfe1) is determined. The method also comprises extrapolating one or more replacement frames based upon the first preliminary time lag (ppfe1) and the scaling factor (ptfe).

45 Claims, 4 Drawing Sheets

OTHER PUBLICATIONS

International Search Report from PCT Application No. PCT/US02/26255, filed Aug. 19, 2002, 4 pages, (mailed Jan. 27, 2003).

Written Opinion from PCT Application No. PCT/US02/26255, filed Aug. 19, 2002, 6 pages, (mailed Oct. 22, 2003).

Supplementary European Search Report issued Jun. 9, 2006 for Appl. No. EP 02757200, 4 pages.

Watkins, Craig R. et al., "Improving 16 KB/S G.728 LD-CELP Speech Coder for Frame Erasure Channels," Acoustics, Speech and Signal Processing, Conference on Detroit, MI, USA May 9-12, 1995, New York, NY, USA, IEEE, US, vol. 1, May 9, 1995, pp. 241-244.

Chen, Juin Hwey, "A High-Fidelity Speech and Audio Codec with Low Delay and Low Complexity," Acoustics, Speech and Signal Processing 2000, 2000 IEEE International Conference on Jun. 5-9, 2000, vol. 2, Jun. 5, 2000, pp. 1161-1164.

Anonymous, "Frame or Packet Loss Concealment for the LD-CELP Decoder," International Telecommunication Union, Geneva, CH, May 1999, 13 pages.

* cited by examiner

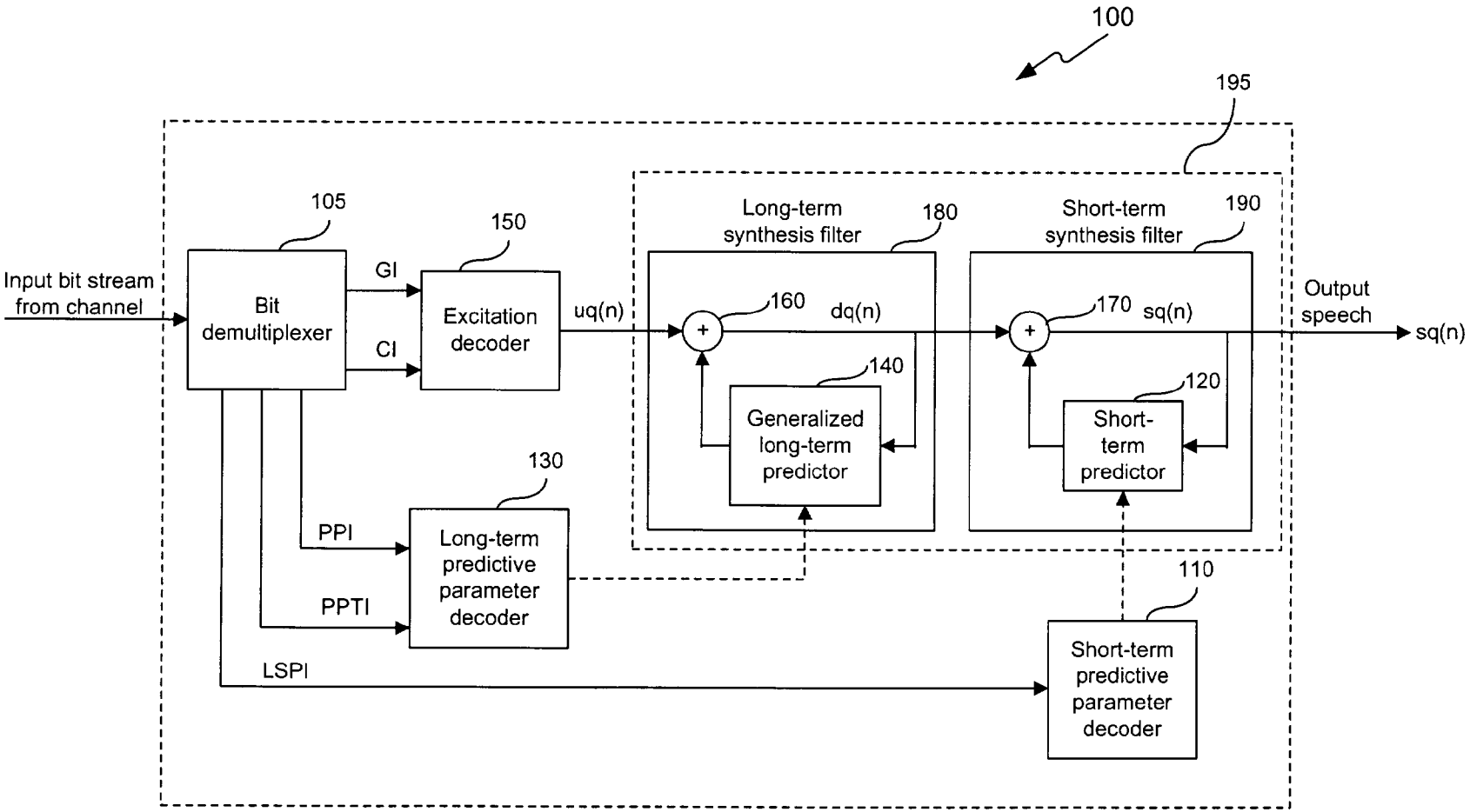
FIG. 1
(conventional)

FRAME ERASURE CONCEALMENT FOR PREDICTIVE SPEECH CODING BASED ON EXTRAPOLATION OF SPEECH WAVEFORM

CROSS-REFERENCE TO RELATED APPLICATIONS

This application claims the benefit of U.S. Provisional Application No. 60/312,789, filed Aug. 17, 2001, entitled "Frame Erasure Concealment for Predictive Speech Coding Based On Extrapolation of Speech Waveform," and U.S. Provisional Application No. 60/344,374, filed Jan. 4, 2002, entitled "Improved Frame Erasure Concealment for Predictive Speech Coding Based On Extrapolation of Speech Waveform," both of which are incorporated by reference herein in their entireties.

BACKGROUND OF THE INVENTION

1. Field of the Invention

The present invention relates to digital communications. More particularly, the present invention relates to the enhancement of speech quality when frames of a compressed bit stream representing a speech signal are lost within the context of a digital communications system.

2. Background Art

In speech coding, sometimes called voice compression, a coder encodes an input speech or audio signal into a digital bit stream for transmission. A decoder decodes the bit stream into an output speech signal. The combination of the coder and the decoder is called a codec. The transmitted bit stream is usually partitioned into frames. In wireless or packet networks, sometimes frames of transmitted bits are lost, erased, or corrupted. This condition is called frame erasure in wireless communications. The same condition of erased frames can happen in packet networks due to packet loss. When frame erasure happens, the decoder cannot perform normal decoding operations since there are no bits to decode in the lost frame. During erased frames, the decoder needs to perform frame erasure concealment (FEC) operations to try to conceal the quality-degrading effects of the frame erasure.

One of the earliest FEC techniques is waveform substitution based on pattern matching, as proposed by Goodman, et al. in "Waveform Substitution Techniques for Recovering Missing Speech Segments in Packet Voice Communications", *IEEE Transaction on Acoustics, Speech and Signal Processing,* December 1986, pp. 1440-1448. This scheme was applied to Pulse Code Modulation (PCM) speech codec that performs sample-by-sample instantaneous quantization of speech waveform directly. This FEC scheme uses a piece of decoded speech waveform immediately before the lost frame as the template, and slides this template back in time to find a suitable piece of decoded speech waveform that maximizes some sort of waveform similarity measure (or minimizes a waveform difference measure).

Goodman's FEC scheme then uses the section of waveform immediately following a best-matching waveform segment as the substitute waveform for the lost frame. To eliminate discontinuities at frame boundaries, the scheme also uses a raised cosine window to perform an overlap-add technique between the correctly decoded waveform and the substitute waveform. This overlap-add technique increases the coding delay. The delay occurs because at the end of each frame, there are many speech samples that need to be overlap-added to obtain the final values, and thus cannot be played out until the next frame of speech is decoded.

Based on the work of Goodman above, David Kapilow developed a more sophisticated version of an FEC scheme for G.711 PCM codec. This FEC scheme is described in Appendix I of the ITU-T Recommendation G.711. However, both the FEC of Goodman and the FEC scheme of Kapilow are limited to PCM codecs with instantaneous quantization.

For speech coding, the most popular type of speech codec is based on predictive coding. Perhaps the first publicized FEC scheme for a predictive codec is a "bad frame masking" scheme in the original TIA IS-54 VSELP standard for North American digital cellular radio (rescinded in September 1996). Here, upon detection of a bad frame, the scheme repeats the linear prediction parameters of the last frame. This scheme derives the speech energy parameter for the current frame by either repeating or attenuating the speech energy parameter of last frame, depending on how many consecutive bad frames have been counted. For the excitation signal (or quantized prediction residual), this scheme does not perform any special operation. It merely decodes the excitation bits, even though they might contain a large number of bit errors.

The first FEC scheme for a predictive codec that performs waveform substitution in the excitation domain is probably the FEC system developed by Chen for the ITU-T Recommendation G.728 Low-Delay Code Excited Linear Predictor (CELP) codec, as described in U.S. Pat. No. 5,615,298 issued to Chen, titled "Excitation Signal Synthesis During Frame Erasure or Packet Loss." In this approach, during erased frames, the speech excitation signal is extrapolated depending on whether the last frame is a voiced or an unvoiced frame. If it is voiced, the excitation signal is extrapolated by periodic repetition. If it is unvoiced, the excitation signal is extrapolated by randomly repeating small segments of speech waveform in the previous frame, while ensuring the average speech power is roughly maintained.

What is needed therefore is an FEC technique that avoids the noted deficiencies associated with the conventional decoders. For example, what is needed is an FEC technique that avoids the increased delay created in the overlap-add operation of Goodman's approach. What is also needed is an FEC technique that can ensure the smooth reproduction of a speech or audio waveform when the next good frame is received.

BRIEF SUMMARY OF THE INVENTION

Consistent with the principles of the present invention as embodied and broadly described herein, an exemplary FEC technique includes a method of synthesizing a number of corrupted frames output from a decoder including one or more predictive filters. The corrupted frames are representative of one segment of a decoded signal (sq(n)) output from the decoder. The method comprises determining a first preliminary time lag (ppfe1) based upon examining a predetermined number (K) of samples of another segment of the decoded signal and determining a scaling factor (ptfe) associated with the examined number (K) of samples when the first preliminary time lag (ppfe1) is determined. The method also comprises extrapolating one or more replacement frames based upon the first preliminary time lag (ppfe1) and the scaling factor (ptfe).

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated in and constitute a part of the specification, illustrate an embodiment of the invention and, together with the description, explain the purpose, advantages, and principles of the invention. In the drawings:

FIG. 1 is a block diagram illustration of a conventional predictive decoder;

FIG. 3(*b*) is a plot of an exemplary normalized waveform attenuation window functioning in accordance with the present invention.

DETAILED DESCRIPTION OF INVENTION

Figure 2:
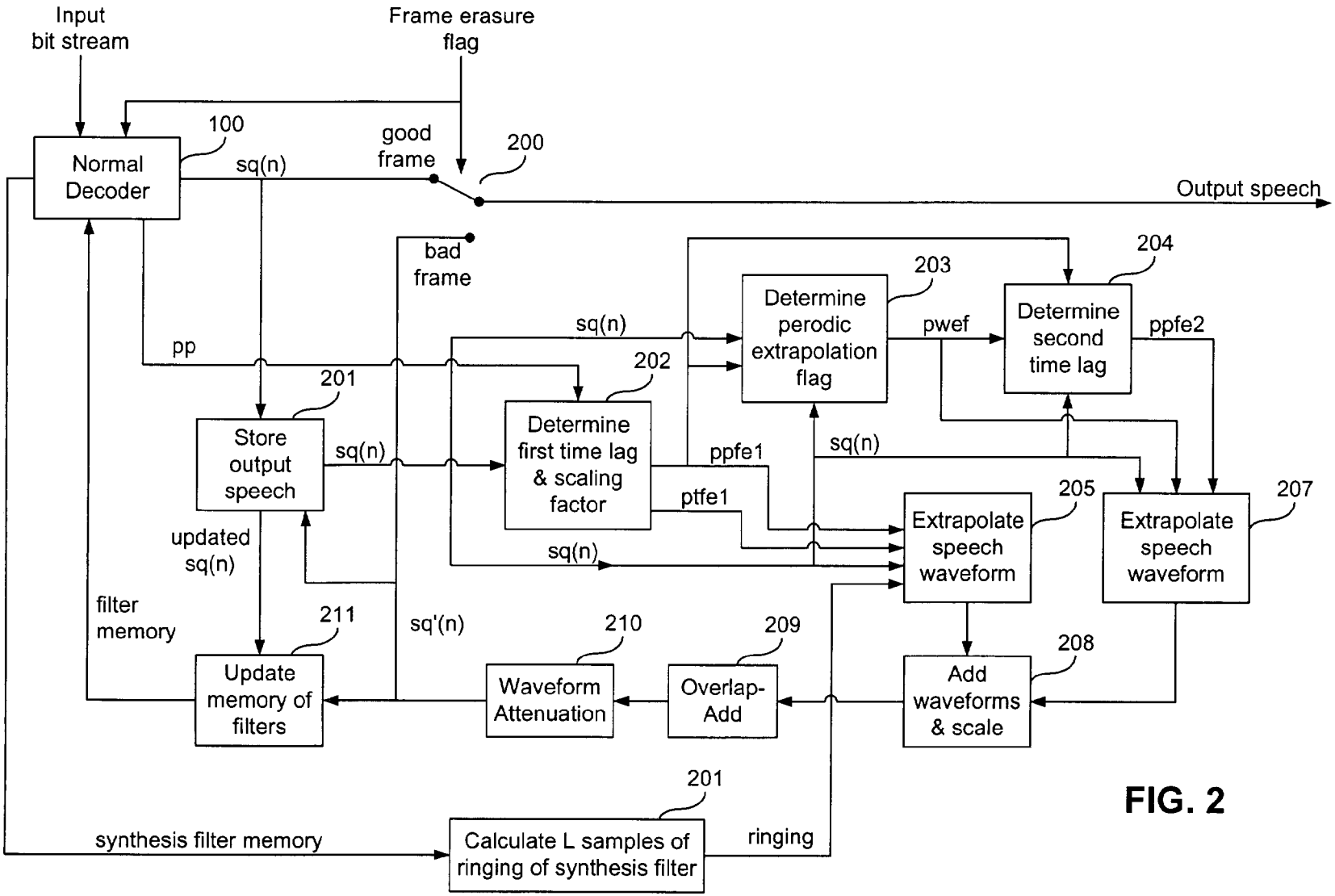
FIG. 2 is a block diagram illustration of an exemplary decoder constructed and arranged in accordance with the present invention.

The following detailed description of the present invention refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

It would be apparent to one of skill in the art that the present invention, as described below, may be implemented in many different embodiments of hardware, software, firmware, and/or the entities illustrated in the drawings. Any actual software code with specialized control hardware to implement the present invention is not limiting of the present invention. Thus, the operation and behavior of the present invention will be described with the understanding that modifications and variations of the embodiments are possible, given the level of detail presented herein. Before describing the invention in detail, it is helpful to describe an exemplary environment in which the invention may be implemented.

The present invention is particularly useful in the environment of the decoder of a predictive speech codec to conceal the quality-degrading effects of frame erasure or packet loss. FIG. 1 illustrates-such an environment. The general principles of the invention can be used in any linear predictive codec, although the preferred embodiment described later is particularly well suited for a specific type of predictive decoder.

The invention is an FEC technique designed for predictive coding of speech. One characteristic that distinguishes it from the techniques mentioned above, is that it performs waveform substitution in the speech domain rather than the excitation domain. It also performs special operations to update the internal states, or memories, of predictors and filters inside the predictive decoder to ensure maximally smooth reproduction of speech waveform when the next good frame is received.

The present invention also avoids the additional delay associated with the overlap-add operation in Goodman's approach and in ITU-T G.711 Appendix I. This is achieved by performing overlap-add between extrapolated speech waveform and the ringing, or zero-input response of the synthesis filter. Other features include a special algorithm to minimize buzzing sounds during waveform extrapolation, and an efficient method to implement a linearly decreasing waveform envelope during extended frame erasure. Finally, the associated memories within the log-gain predictor are updated.

The present invention is not restricted to a particular speech codec. Instead, it's generally applicable to predictive speech codecs, including, but not limited to, Adaptive Predictive Coding (APC), Multi-Pulse Linear Predictive Coding (MPLPC), CELP, and Noise Feedback Coding (NFC), etc.

Before discussing the principles of the invention, a description of a conventional decoder of a standard predictive codec is needed. FIG. 1 is a block diagram illustration of a conventional predictive decoder 100. The decoder 100 shown in FIG. 1 can be used to describe the decoders of APC, MPLPC, CELP, and NFC speech codecs. The more sophisticated versions of the codecs associated with predictive decoders typically use a short-term predictor to exploit the redundancy among adjacent speech samples and a long-term predictor to exploit the redundancy between distant samples due to pitch periodicity of, for example, voiced speech.

The main information transmitted by these codecs is the quantized version of the prediction residual signal after short-term and long-term prediction. This quantized residual signal is often called the excitation signal, because it is used in the decoder to excite the long-term and short-term synthesis filter to produce the output decoded speech. In addition to the excitation signal, several other speech parameters are also transmitted as side information frame-by-frame or subframe-by-subframe.

An exemplary range of lengths for each frame (called frame size) is 5 ms to 40 ms, with 10 ms and 20 ms as the two most popular frame sizes for speech codecs. Each frame usually contains a few equal-length subframes. The side information of these predictive codecs typically includes spectral envelope information (in the form of the short-term predictor parameters), pitch period, pitch predictor taps (both long-term predictor parameters), and excitation gain.

In FIG. 1, the conventional decoder 100 includes a bit de-multiplexer 105. The de-multiplexer 105 separates the bits in each received frame of bits into codes for the excitation signal and codes for short-term predictor, long-term predictor, and the excitation gain.

The short-term predictor parameters, often referred to as the linear predictive coding (LPC) parameters, are usually transmitted once a frame. There are many alternative parameter sets that can be used to represent the same spectral envelope information. The most popular of these is the line-spectrum pair (LSP) parameters, sometimes called line-spectrum frequency (LSF) parameters. In FIG. 1, LSPI represents the transmitted quantizer codebook index representing the LSP parameters in each frame. A short-term predictive parameter decoder 110 decodes LSPI into an LSP parameter set and then converts the LSP parameters to the coefficients for the short-term predictor. These short-term predictor coefficients are then used to control the coefficient update of a short-term predictor 120.

Pitch period is defined as the time period at which a voiced speech waveform appears to be repeating itself periodically at a given moment. It is usually measured in terms of a number of samples, is transmitted once a subframe, and is used as the bulk delay in long-term predictors. Pitch taps are the coefficients of the long-term predictor. The bit de-multiplexer 105 also separates out the pitch period index (PPI) and the pitch predictor tap index (PPTI), from the received bit stream. A long-term predictive parameter decoder 130 decodes PPI into the pitch period, and decodes the PPTI into the pitch predictor taps. The decoded pitch period and pitch predictor taps are then used to control the parameter update of a generalized long-term predictor 140.

In its simplest form, the long-term predictor 140 is just a finite impulse response (FIR) filter, typically first order or third order, with a bulk delay equal to the pitch period. However, in some variations of CELP and MPLPC codecs, the long-term predictor 140 has been generalized to an adaptive codebook, with the only difference being that when the pitch period is smaller than the subframe, some periodic repetition operations are performed. The generalized long-term predictor 140 can represent either a straightforward FIR filter, or an adaptive codebook, thus covering most of the predictive speech codecs presently in use.

The bit de-multiplexer 105 also separates out a gain index GI and an excitation index CI from the input bit stream. An excitation decoder 150 decodes the CI into an unscaled excitation signal, and also decodes the GI into the excitation gain. Then, it uses the excitation gain to scale the unscaled excitation signal to derive a scaled excitation gain signal uq(n), which can be considered a quantized version of the long-term prediction residual. An adder 160 combines the output of the generalized long-term predictor 140 with the scaled excitation gain signal uq(n) to obtain a quantized version of a short-term prediction residual signal dq(n). An adder 170 combines the output of the short-term predictor 120 to dq(n) to obtain an output decoded speech signal sq(n).

A feedback loop is formed by the generalized long-term predictor 140 and the adder 160 and can be regarded as a single filter, called a long-term synthesis filter 180. Similarly, another feedback loop is formed by the short term predictor 120 and the adder 170. This other feedback loop can be considered a single filter called a short-term synthesis filter 190. The long-term synthesis filter 180 and the short-term synthesis filter 190 combine to form a synthesis filter module 195.

In summary, the conventional predictive decoder 100 depicted in FIG. 1 decodes the parameters of the short-term predictor 120 and the long-term predictor 140, the excitation gain, and the unscaled excitation signal. It then scales the unscaled excitation signal with the excitation gain, and passes the resulting scaled excitation signal uq(n) through the long-term synthesis filter 180 and the short-term synthesis filter 190 to derive the output decoded speech signal sq(n).

When a frame of input bits is erased due to fading in a wireless transmission or due to packet loss in packet networks, the decoder 100 in FIG. 1 unfortunately looses the indices LSPI, PPI, PPTI, GI, and CI, needed to decode the speech waveform in the current frame.

According to the principles of the present invention, the decoded speech waveform immediately before the current frame is stored and analyzed. A waveform-matching search, similar to the approach of Goodman is performed, and the time lag and scaling factor for repeating the previously decoded speech waveform in the current frame are identified.

Next, to avoid the occasional buzz sounds due to repeating a waveform at a small time lag when the speech is not highly periodic, the time lag and scaling factor are sometimes modified as follows. If the analysis indicates that the stored previous waveform is not likely to be a segment of highly periodic voiced speech, and if the time lag for waveform repetition is smaller than a predetermined threshold, another search is performed for a suitable time lag greater than the predetermined threshold. The scaling factor is also updated accordingly.

Once the time lag and scaling factor have been determined, the present invention copies the speech-waveform one time lag earlier to fill the current frame, thus creating an extrapolated waveform. The extrapolated waveform is then scaled with the scaling factor. The present invention also calculates a number of samples of the ringing, or zero-input response, output from the synthesis filter module 195 from the beginning of the current frame. Due to the smoothing effect of the short-term synthesis filter 190, such a ringing signal will seem to flow smoothly from the decoded speech waveform at the end of the last frame. The present invention then overlap-adds this ringing signal and the extrapolated speech waveform with a suitable overlap-add window in order to smoothly merge these two pieces of waveform. This technique will smooth out waveform discontinuity at the beginning of the current frame. At the same time, it avoids the additional delays created by G.711 Appendix I or the approach of Goodman.

If the frame erasure has persisted for an extended period of time, the extrapolated speech signal is attenuated toward zero. Otherwise, it will create a tonal or buzzing sound. In the present invention, the waveform envelope is attenuated linearly toward zero if the length of the frame erasure exceeds a certain threshold. The present invention then uses a memory-efficient method to implement this linear attenuation toward zero.

After the waveform extrapolation is performed in the erased frame, the present invention properly updates all the internal memory states of the filters within the speech decoder. If updating is not performed, there would be a large discontinuity and an audible glitch at the beginning of the next good frame. In updating the filter memory after a frame erasure, the present invention works backward from the output speech waveform. The invention sets the filter memory contents to be what they would have been at the end of the current frame, if the filtering operations of the speech decoder were done normally. That is, the filtering operations are performed with a special excitation such that the resulting synthesized output speech waveform is exactly the same as the extrapolated waveform calculated above.

As an example, if the short-term predictor 120 is of an order M, then the memory of the short-term synthesis filter 190, after the FEC operation for the current frame, is simply the last M samples of the extrapolated speech signal for the current frame with the order reversed. This is because the short-term synthesis filter 190 in the conventional decoder 100 is an all-pole filter. The filter memory is simply the previous filter output signal samples in reverse order.

An example of updating the memory of the FIR long-term predictor 140 will be presented. In this example, the present invention performs short-term prediction error filtering of the extrapolated speech signal of the current frame, with initial memory of the short-term predictor 120 set to the last M samples (in reverse order) of the output speech signal in the last frame.

Similarly, if quantizers for side information (such as LSP and excitation gain) use inter-frame predictive coding, then the memories of those predictors are also updated based on the same principle to minimize the discontinuity of decoded speech parameters at the next good frame.

After the first received good frame following a frame erasure, the present invention also attempts to correct filter memories within the long-term synthesis filter 180 and the short-term synthesis 190 filter if certain conditions are met. Conceptually, the present invention first performs linear interpolation between the pitch period of the last good frame before the erasure and the pitch period of the first good frame after the erasure. Such linear interpolation of the pitch period is performed for each of the erased frames. Based on this linearly interpolated pitch contour, the present invention then re-extrapolates the long-term synthesis filter memory and re-calculates the short-term synthesis filter memory at the end of the last erased frame (i.e., before decoding the first good frame after the erasure).

The general principles of the present invention outlined above are applicable to almost any predictive speech decoder. What will be described in greater detail below is a particular implementation of those general principles, in a preferred embodiment of the present invention applied to the decoder of a two-stage noise feedback codec.

FIG. 2 is a block diagram illustration of an exemplary embodiment of the present invention. The decoder can be, for example, the decoder 100 shown in FIG. 1. Also included in the embodiment of FIG. 2 is an input frame erasure flag switch 200. If the input frame erasure flag 200 indicates that the current frame received is a good frame, the decoder 100 performs the normal decoding operations as described above. If, however, the frame is the first good frame after a frame erasure, the long-term and short-term synthesis filter memories can be corrected before starting the normal decoding. When a good frame is received, the frame erasure flag switch 200 is in the upper position, and the decoded speech waveform sq(n) is used as the output of the system. Furthermore, the current frame of decoded speech sq(n) is also passed to a module 201, which stores the previously decoded speech waveform samples in a buffer. The current frame of decoded speech sq(n) is used to update that buffer. The remaining modules in FIG. 2 are inactive during a good frame.

On the other hand, if the input frame erasure flag switch 200 indicates that the current frame was not received, was erased, or was corrupted, then the operation of the decoder 100 is halted and the frame erasure flag switch 200 is changes to the lower position. The remaining modules of FIG. 2 then perform frame erasure concealment operations to produce the output speech waveform sq'(n) for the current frame, and also update the filter memories of the decoder 100 to prepare the decoder 100 for the normal decoding operations of the next received good frame. The remaining modules of FIG. 2 work in the following way.

A module 201 calculates L samples of "ringing," or zero-input response, of the synthesis filter in FIG. 1. A simpler approach is to use only the short-term synthesis filter 190, but a more effective approach (at least for voiced speech) is to use the ringing of the cascaded long-term and short-term synthesis filters 180 and 190. This is done in the following way. Starting with the memory of the synthesis filter (or filters) left in the delay line after the processing of the last frame, the filtering operations for L samples are performed while using a zero input signal to the filter. The resulting L samples of the long-term synthesis filter output signal form the desired "long-term filter ringing" signal, ltr(n), n=1, 2, . . . , L. The resulting L samples of the short-term synthesis filter output signal are simply called the "ringing" signal, r(n), n=1, 2, . . . , L. Both ltr(n) and r(n) are stored for later use.

A module 202 analyzes the previously decoded speech waveform samples stored in the module 201 to determine a first time lag ppfe1 and an associated scaling factor ptfe1 for waveform extrapolation in the current frame. This can be done in a number of ways. One way, for example, uses the approaches outlined by Goodman et al. And discussed above. If there are multiple consecutive frames erased, the module 202 is active only at the first erased frame. From the second erased frame on, the time lag and scaling factor found in the first erased frame are used.

The present invention will typically usually just search for a "pitch period" in the general sense, as in a pitch-prediction-based speech codec. If the decoder 100 has a decoded pitch period of the last frame, and if it is deemed reliable, then the embodiment of FIG. 2 will simply search around the neighborhood of this pitch period pp to find a suitable time lag. If the decoder 100 does not provide a decoded pitch period, or if this pitch period is deemed unreliable, then the embodiment of FIG. 2 will perform a full-scale pitch estimation to get the desired time lag. In FIG. 2, it is assumed that such a decoded pitch period pp is indeed available and reliable. In this case, the embodiment of FIG. 2 operates as follows.

Let pplast denote the pitch period of the last good frame before the frame erasure. If pplast is smaller than 10 ms (80 samples and 160 samples for 8 kHz and 16 kHz sampling rates, respectively), the module 202 uses it as the analysis window size K. If pplast is greater than 10 ms, the module 202 uses 10 ms as the analysis window size K.

The module 202 then determines the pitch search range as follows. It subtracts 0.5 ms (4 samples and 8 samples for 8 kHz and 16 kHz sampling, respectively) from pplast, compares the result with the minimum allowed pitch period in the codec, and chooses the larger of the two as the lower bound of the search range, lb. It then adds 0.5 ms to pplast, compares the result with the maximum allowed pitch period in the codec, and chooses the smaller of the two as the upper bound of the search range, ub.

The sq(n) buffer in the module 201 stores $N+N_f$ samples of speech, where the samples sq(n), n=1, 2, . . . , N correspond to the decoder output speech for previous frames, with sq(N) being the last sample of decoded speech in the last frame. $N_f$ is the number of samples in a frame. The storage spaces sq(n), n=N+1, N+2, . . . , $N+N_f$ are unpopulated at the beginning of a bad frame, but will be filled with extrapolated speech waveform samples once the operations of the modules 202 through 210 are completed.

For time lags j=lb, lb+1, lb+2, . . . , ub−1, ub, the odule 202 calculates the correlation value $$c(j) = \sum_{n=N-K+1}^{N} sq(n)sq(n-j)$$

for j∈[lb, ub]. Among those time lags that give a positive correlation c(j), module 202 finds the time lag j that maximizes $$nc(j) = \frac{\left(\sum_{n=N-K+1}^{N} sq(n)sq(n-j)\right)^2}{\sum_{n=N-K+1}^{N} sq^2(n-j)}.$$

The division operation above can be avoided by the "cross-multiply" method.

The time lag j that maximizes nc(j) is also the time lag within the search range that maximizes the pitch prediction gain for a single-tap pitch predictor. This is called the optimal time lag ppfe1, which stands for pitch period for frame erasure, $1^{st}$ version. In the extremely rare case where no c(j) in the search range is positive, ppfe1 is set to lb in this degenerate case.

Once ppfe1 is identified, the associated scaling factor ptfe1 is calculated as follows.

$$ptfe1 = sign[c(ppfe1)] \times \frac{\sum_{n=N-K+1}^{N} |sq(n)|}{\sum_{n=N-K+1}^{N} |sq(n-ppfe1)|}$$

Such a calculated scaling factor ptfe1 is then clipped to 1 if it is greater than 1 and clipped to −1 if it is less than −1. Also, in the degenerate case when the denominator on the right-hand side of the above equation is zero, ptfe1 is set to 0.

Although the module 202 performs the above calculation only for the first erased frame when there are multiple consecutive erased frames, it also attempts to modify the first time lag ppfe1 at the second consecutively erased frame, depending on the pitch period contour at the good frames immediately before the erasure. Starting from the last good frame before the erasure, and going backward frame-by-frame for up to 4 frames, the module 202 compares the transmitted pitch period until there is a change in the transmitted pitch period. If there is no change in pitch period found during these 4 good frames before the erasure, then the first time lag ppfe1 found above at the first erased frame is also used for the second consecutively erased frame. Otherwise, the first pitch change identified in the backward search above is examined to see if the change is relatively small. If the change is within 5%, then, depending on how many good frames back the pitch change is found, the amount of pitch period change per frame is calculated and is rounded to the nearest integer. The module 202 then adds this rounded pitch period change per frame, whether positive or negative, to the ppfe1 found above at the first erased frame. The resulting value is used as the first time lag ppfe1 for the second and subsequent consecutively erased frames. This modification of the first time lag after the second erased frame improves the speech quality on average.

It has been discovered that if this time lag is used directly as the time lag for periodic repetition in waveform extrapolation of the current frame, buzz sounds occur when a small time lag is used in a segment of speech that does not have a high degree of periodicity. To combat this problem, the present invention uses a module 203 to distinguish between highly periodic voiced speech segments and other types of speech segments. If the module 203 determines that the decoded speech is in a highly periodic voiced speech region, it sets the periodic waveform extrapolation flag pwef to 1; otherwise, pwef is set to 0. If pwef is 0, and if the first time lag ppfe1 is less than a threshold of 10 ms, then a module 204 will find a second, larger time lag ppfe2 greater than 10 ms to reduce or eliminate the buzz sound.

Using ppfe1 as its input, the module 203 performs further analysis of the previously decoded speech sq(n) to determine the periodic waveform extrapolation flag pwef. Again, this can be done in many possible ways. One exemplary method of determining the periodic waveform flag pwef is described below.

The module 203 calculates three signal features: signal gain relative to long-term average of input signal level, pitch prediction gain, and the first normalized autocorrelation coefficient. It then calculates a weighted sum of these three signal features, and compares the resulting figure of merit with a pre-determined threshold. If the threshold is exceeded, pwef is set to 1, otherwise it is set to 0. The mopdule 203 then performs special handling for extreme cases.

The three signal features are calculated as follows. First, the module 203 calculates the speech energy in the analysis window:

$$E = \sum_{n=N-K+1}^{N} sq^2(n)$$

If E>0, the base-2 logarithmic gain is calculated as $lg=\log_2 E$; otherwise, lg is set to 0. Let lvl be the long-term average logarithmic gain of the active portion of the speech signal (that is, not counting the silence). A separate estimator for input signal level can be employed to calculate lvl. An exemplary signal level estimator is disclosed in U.S. Provisional Application No. 60/312,794, filed Aug. 17, 2001, entitled "Bit Error Concealment Methods for Speech Coding," and U.S. Provisional Application No. 60/344,378, filed Jan. 4, 2002, entitled "Improved Bit Error Concealment Methods for Speech Coding." The normalized logarithmic gain (i.e., signal gain relative to long-term average input signal level) is then calculated as nlg=lg−lvl.

The module 203 further calculates the first normalized autocorrelation coefficient $$\rho_1 = \frac{\sum_{n=N-K+2}^{N} sq(n)sq(n-1)}{E}$$

In the degenerate case when E=0, $\rho_1$ is set to 0 as well. The module 203 also calculates the pitch prediction gain as $$ppg = 10\log_{10}\left(\frac{E}{R}\right),$$

where $$R = E - \frac{c^2(ppfe1)}{\sum_{n=N-K+1}^{N} sq^2(n-ppfe1)}$$

is the pitch prediction residual energy. In the degenerate case when R=0, ppg is set to 20.

The three signal features are combined into a single figure of merit:

$$fom = nlg + 1.25\,ppg + 16\rho_1$$

If fom>16, pwef is set to 1, otherwise it is set to 0. Afterward, the flag pwef may be overwritten in the following extreme cases:

If nlg<−1, pwef is set to 0.

If ppg>12, pwef is set to 1.

If $\rho_1$<−0.3, pwef is set to 0.

If pwef=0 and ppfe1<$T_0$, where $T_0$ is the number of samples corresponding to 10 ms, there is a high likelihood for periodic waveform extrapolation to produce a buzz sound. To avoid the potential buzz sound, the present invention searches for a second time lag ppfe2≧$T_0$. Two waveforms, one extrapolated using the first time lag ppfe1, and the other extrapolated using the second time lag ppfe2, are added together and properly scaled, and the resulting waveform is used as the output speech of the current frame. By requiring the second time lag ppfe2 to be large enough, the likelihood of a buzz sound is greatly reduced. To minimize the potential quality degradation caused by a misclassification of a periodic voiced speech segment into something that is not, the present invention searches in the neighborhood of the first integer multiple of ppfe1 that is no smaller than $T_0$. Thus, even if the flag pwef should have been 1 and is misclassified as 0, there is a good chance that an integer multiple of the true pitch period will be chosen as the second time lag ppfe2 for periodic waveform extrapolation.

A module 204 determines the second time lag ppfe2 in the following way if pwef=0 and ppfe1<$T_0$. First, it finds the smallest integer m that satisfies $$m \times ppfe1 > T_0.$$

Next, the module 204 sets $m_1$, the lower bound of the time lag search range, to m×ppfe1−3 or $T_0$, whichever is larger. The upper bound of the search range is set to $m_2=m_1+N_f-1$, where $N_f$ is the number of possible time lags in the search range. Next, for each time lag j in the search range of $[m_1, m_2]$, the module 204 calculates $$cor(j) = \sum_{n=N-N_f+1}^{N} sq(n)sq(n-j)$$

and then selects the time lag j $\in[m_1, m_2]$ that maximizes cor(j). The corresponding scaling factor is set to 1.

The module 205 extrapolates speech waveform for the current erased frame based on the first time lag ppfe1. It first extrapolates the first L samples of speech in the current frame using the first time lag ppfe1 and the corresponding scaling factor ptfe1. A suitable value of L is 8 samples. The extrapolation of the first L samples of the current frame can be expressed as $$sq(n)=ptfe1 \times sq(n-ppfe1), \text{ for } n=N+1, N+2, \ldots, N+L.$$

For the first L samples of the current frame, the module 205 smoothly merges the sq(n) signal extrapolated above with r(n), the ringing of the synthesis filter calculated in module 206, using the overlap-add method below.

$$sq(N+n) \leftarrow w_u(n)sq(N+n)+w_d(n)r(n), \text{ for } n=1, 2, \ldots, L.$$

In the equation above, the sign "←" means the quantity on its right-hand side overwrites the variable values on its left-hand side. The window function $w_u(n)$ represents the overlap-add window that is ramping up, while $w_d(n)$ represents the overlap-add window that is ramping down. These overlap-add windows satisfy the constraint:

$$w_u(n)+w_d(n)=1$$

A number of different overlap-add windows can be used. For example, the raised cosine window mentioned in the paper by Goodman et al. Is one exemplary method. Alternatively, simpler triangular windows can also be used.

After the first L samples of the current frame are extrapolated and overlap-added, the module 205 then extrapolates the remaining samples of the current frame.

If ppfe1≧$N_f$, the extrapolation is performed as $$sq(n)=ptfe1 \times sq(n-ppfe1), \text{ for } n=N+L+1, N+L+2, \ldots, N+N_f.$$

If ppfe1 <$N_f$, then the extrapolation is performed as $$sq(n)=ptfe1 \times sq(n-ppfe1), \text{ for } n=N+L+1, N+L+2, \ldots, N+ppfe1, \text{ and}$$

then $$sq(n)=sq(n-ppfe1), \quad \text{for} \quad n=N+ppfe1+1, \quad N+ppfe1+2, \ldots, N+N_f.$$

A module 207 extrapolates speech waveform for the current erased frame based on the second time lag ppfe2. Its output extrapolated speech waveform $sq_2(n)$ is given by $$sq_2(n) = \begin{cases} sq(n-ppfe2), & \text{for } n = N+1, \ldots, N+N_f, \text{ if } pwef = 0 \text{ and } ppfe1 < T_0 \\ 0, & \text{for } n = N+1, \ldots, N+N_f, \text{ if } pwef \neq 0 \text{ or } ppfe1 \geq T_0 \end{cases}$$

If the $sq_2(n)$ waveform is zero, a module 208 directly passes the output of the module 205 to a module 209. Otherwise, the module 208 adds the output waveforms of the modules 205 and 207, and scales the result appropriately. Specifically, it calculates the sums of signal sample magnitudes for the outputs of the modules 205 and 207:

$$sum1 = \sum_{n=N+1}^{N+N_f} |sq(n)|$$

$$sum2 = \sum_{n=N+1}^{N+N_f} |sq_2(n)|$$

It then adds the two waveforms and assign the result to sq(n) again:

$$sq(n) \leftarrow sq(n)+sq_2(n), \text{ for } n=N+1, N+2, \ldots, N+N_f.$$

Next, it calculates the sum of signal sample magnitudes for the summed waveform:

$$sum3 = \sum_{n=N+1}^{N+N_f} |sq(n)|$$

If sum3 is zero, the scaling factor is set to 1; otherwise, the scaling factor is set to sfac=min(sum1, sum2)/sum3, where min(sum1, sum2) means the smaller of sum1 and sum2. After this scaling factor is calculated, the module 208 replaces sq(n) with a scaled version: sq(n)←sfac×sq(n), for n=N+1, N+2, . . . , N+$N_f$, and the module 209 performs overlap-add of sq(n) and the ringing of the synthesis filter for the first L samples of the frame. The resulting waveform is passed to the module 210.

If the frame erasure lasts for an extended time period, the frame erasure concealment scheme should not continue the periodic extrapolation indefinitely, otherwise the extrapolated speech sounds like some sort of steady tone signal. In the preferred embodiment of the present invention, the module 210 starts waveform attenuation at the instant when the frame erasure has lasted for 20 ms. From there, the envelope of the extrapolated waveform is attenuated linearly toward zero and the waveform magnitude reaches zero at 60 ms into the erasure of consecutive frames. After 60 ms, the output is completely muted. See FIG. 3 (*a*) for a waveform attenuation window that implements this attenuation strategy.

The preferred embodiment of the present invention is used with a noise feedback codec that has a frame size of 5 ms. In this case, the time interval between each adjacent pair of vertical lines in FIG. 3 (*a*) represent a frame.

Figure 3A:
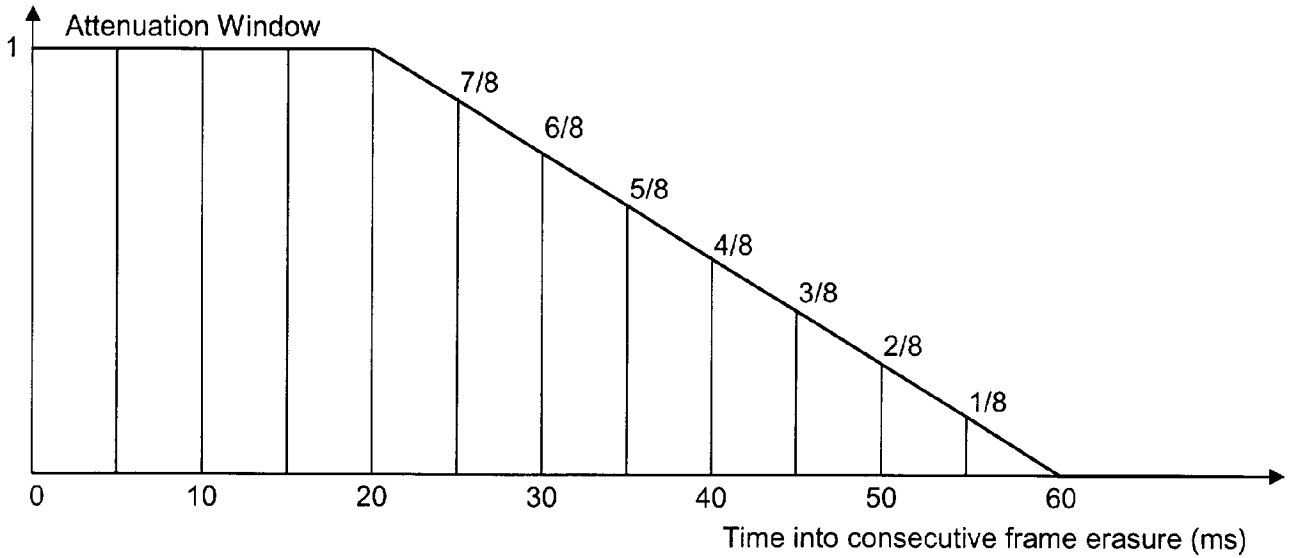
FIG. 3(*a*) is a plot of an exemplary unnormalized waveform attenuation window functioning in accordance with the present invention.
Figure 3B:
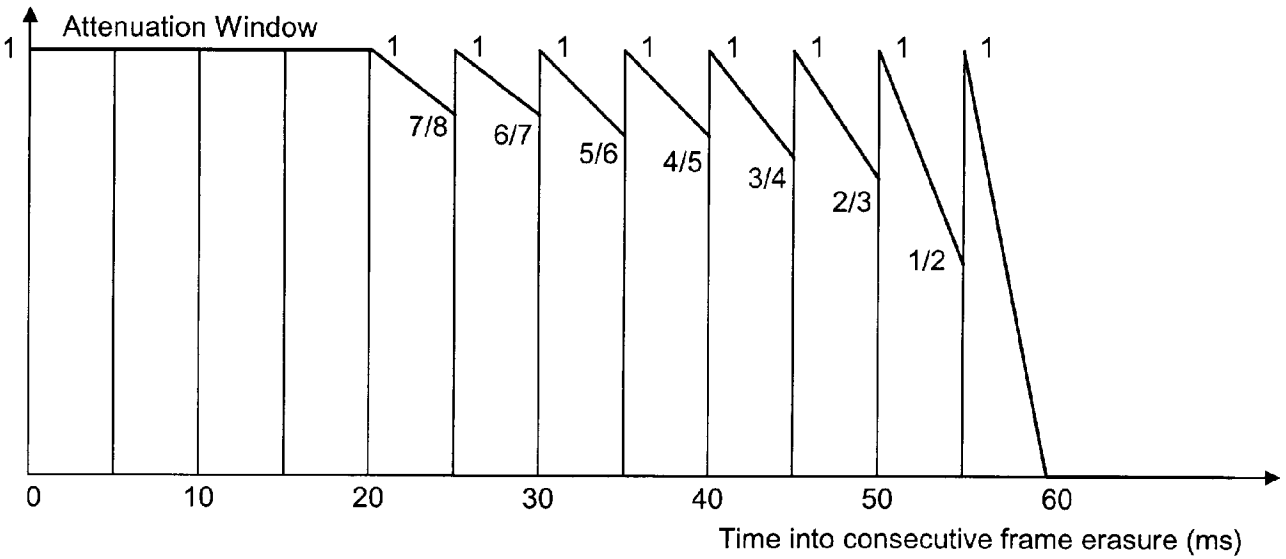

Suppose a frame erasure lasts for 12 consecutive frames (5×12=60 ms) or more, the easiest way to implement this waveform attenuation is to extrapolate speech for the first 12 erased frames, store the resulting 60 ms of waveform, and then apply the attenuation window in FIG. 3 (*a*). However, this simple approach requires extra delay to buffer up 60 ms of extrapolated speech.

To avoid any additional delay, the module 210 applies the waveform attenuation window frame-by-frame without any additional buffering. However, starting from the sixth consecutive erased frame (from 25 ms on in FIG. 3), the module 210 cannot directly apply the corresponding section of the window for that frame in FIG. 3 (*a*). A waveform discontinuity will occur at the frame boundary, because the corresponding section of the attenuation window starts from a value less than unity (7/8, 6/8, 5/8, etc.). This will cause a sudden decrease of waveform sample value at the beginning of the frame, and thus an audible waveform discontinuity.

To eliminate this problem, the present invention normalizes each 5 ms section of the attenuation window in FIG. 3 (*a*) by its starting value at the left edge. For example, for the sixth frame (25 ms to 30 ms), the window is from 7/8 to 6/8, and normalizing this section by 7/8 will give a window from 1 to (6/8)/(7/8)=6/7. Similarly, for the seventh frame (30 ms to 35 ms), the window is from 6/8 to 5/8, and normalizing this section by 6/8 will give a window from 1 to (5/8)/(6/8)=5/6. Such normalized attenuation window for each frame is shown in FIG. 3 (*b*).

Rather than storing every sample in the normalized attenuation window in FIG. 3 (*b*), the present invention simply stores the decrement between adjacent samples of the window for each of the eight window sections for fifth to twelfth frame. This decrement is the amount of total decline of the window function in each frame (1/8 for the fifth erased frame, 1/7 for the sixth erased frame, and so on), divided by $N_f$, the number of speech samples in a frame.

If the frame erasure has lasted for only 20 ms or less, the module 210 does not need to perform any waveform attenuation operation. If the frame erasure has lasted for more than 20 ms, then the module 210 applies the appropriate section of the normalized waveform attenuation window in FIG. 3 (*b*), depending on how many consecutive frames have been erased so far. For example, if the current frame is the sixth consecutive frame that is erased, then the module 210 applies the section of the window from 25 ms to 30 ms (with window function from 1 to 6/7). Since the normalized waveform attenuation window for each frame always starts with unity, the windowing operation will not cause any waveform discontinuity at the beginning of the frame.

The normalized window function is not stored; instead, it is calculated on the fly. Starting with a value of 1, the module 210 multiplies the first waveform sample of the current frame by 1, and then reduces the window function value by the decrement value calculated and stored beforehand, as mentioned above. It then multiplies the second waveform sample by the resulting decremented window function value. The window function value is again reduced by the decrement value, and the result is used to scale the third waveform sample of the frame. This process is repeated for all samples of the extrapolated waveform in the current frame.

The output of the module 210, that is, sq'(n) for the current erased frame, is passed through the switch 200 and becomes the final output speech for the current erased frame. The current frame of sq'(n) is passed to the module 201 to update the current frame portion of the sq(n) speech buffer stored there. Let sq'(n), n=1, 2, . . . , $N_f$ be the output of the module 210 for the current erased frame, then the sq(n) buffer of the module 201 is updated as:

$$sq(N+n)=sq'(n),\ n=1, 2, \ldots, N_f.$$

This signal is also passed to a module 211 to update the memory, or internal states, of the filters inside the decoder 100. Such a filter memory update is performed in order to ensure that the filter memory is consistent with the extrapolated speech waveform in the current erased frame. This is necessary for a smooth transition of speech waveform at the beginning of the next frame, if the next frame turns out to be a good frame. If the filter memory were frozen without such proper update, then generally there would be audible glitch or disturbance at the beginning of the next good frame.

If the short-term predictor is of order M, then the updated memory is simply the last M samples of the extrapolated speech signal for the current erased frame, but with the order reversed. Let stsm(k) be the k-th memory value of the short-term synthesis filter, or the value stored in the delay line corresponding to the k-th short-term predictor coefficient $\alpha_k$. Then, the memory of the short-term synthesis filter 190 is updated as $$stsm(k)=sq(N+N_f+1-k),\ k=1, 2, \ldots, M.$$

To update the memory of the long-term synthesis filter 180 of FIG. 1, the module 211 extrapolates the long-term synthesis filter memory based on the first time lag ppfe1, using procedures similar to speech waveform extrapolation performed at the module 205. Let ltsm(n) be the memory (or delay line) of the long-term synthesis filter 180, where the indexing convention is the same as that of sq(n). The module 211 first extrapolates the first L samples of ltsm(n) in the current frame $$ltsm(n)=ptfe1\times ltsm(n-ppfe1),\ \text{for } n=N+1, N+2, \ldots, N+L.$$

Next, this extrapolated filter memory is overlap-added with the ringing of the long-term synthesis filter calculated in the module 201:

$$ltsm(N+n)\leftarrow w_u(n)ltsm(N+n)+w_d(n)ltr(n),\quad \text{for}\quad n=1, 2, \ldots, L.$$

After the first L samples of the current frame are extrapolated and overlap-added, the module 211 then extrapolates the remaining samples of the current frame. If ppfe1 $\geqq N_f$, the extrapolation is performed as $$ltsm(n)=ptfe1\times ltsm(n-ppfe1),\quad \text{for}\quad n=N+L+1,\ N+L+2, \ldots, N+N_f.$$

If ppfe1<$N_f$, then the extrapolation is performed as $$ltsm(n)=ptfe1\times ltsm(n-ppfe1),\quad \text{for}\quad n=N+L+1,\ N+L+2, \ldots, N+ppfe1,$$

and $$ltsm(n)=ltsm(n-ppfe1),\quad \text{for}\quad n=N+ppfe1+1,\ N+ppfe1+2, \ldots, N+N_f.$$

If none of the side information speech parameters (LPC, pitch period, pitch taps, and excitation gain) is quantized using predictive coding, the operations of the module 211 are completed. If, on the other hand, predictive coding is used for side information, then the module 211 also needs to update the memory of the involved predictors to minimize the discontinuity of decoded speech parameters at the next good frame.

In the noise feedback codec that the preferred embodiment of the present invention is used in, moving-average (MA) predictive coding is used to quantize both the Line-Spectrum Pair (LSP) parameters and the excitation gain. The predictive coding schemes for these parameters work as follows. For each parameter, the long-term mean value of that parameter is calculated off-line and subtracted from the unquantized parameter value. The predicted value of the mean-removed parameter is then subtracted from this mean-removed parameter value. A quantizer quantizes the resulting prediction error. The output of the quantizer is used as the input to the MA predictor. The predicted parameter value and the long-term mean value are both added back to the quantizer output value to reconstruct a final quantized parameter value.

In an embodiment of the present invention, the modules 202 through 210 produce the extrapolated speech for the current erased frame. Theoretically, for the current frame, there is no need to extrapolate the side information speech parameters since the output speech waveform has already been generated. However, to ensure that the LSP and gain decoding operations will go smoothly at the next good frame, it is helpful to assume that these parameters are extrapolated from the last frame by simply copying the parameter values from the last frame, and then work "backward" from these extrapolated parameter values to update the predictor memory of the predictive quantizers for these parameters.

Using the principle outlined in the last paragraph, we can update the predictor memory in the predictive LSP quantizer, can be updated as follows. The predicted value for the k-th LSP parameter is calculated as the inner product of the predictor coefficient array and the predictor memory array for the k-th LSP parameter). This predicted value and the long-term mean value of the k-th LSP are subtracted from the k-th LSP parameter value at the last frame. The resulting value is used to update the newest memory location for the predictor of the k-th LSP parameter (after the original set of predictor memory is shifted by one memory location, as is well-known in the art). This procedure is repeated for all the LSP parameters (there are M of them).

If the frame erasure lasts only 20 ms or less, no waveform attenuation window is applied, and an assumption is made that the excitation gain of the current erased frame is the same as the excitation gain of the last frame. In this case, the memory update for the gain predictor is essentially the same as the memory update for the LSP predictors described above. Basically, the predicted value of log-gain is calculated (by calculating the inner product of the predictor coefficient array and the predictor memory array for the log-gain). This predicted log-gain and the long-term mean value of the log-gain are then subtracted from the log-gain value of the last frame. The resulting value is used to update the newest memory location for the log-gain predictor (after the original set of predictor memory is shifted by one memory location, as is well-known in the art).

If the frame erasure lasts more than 60 ms, the output speech is zeroed out, and the base-2 log-gain is assumed to be at an artificially set default silence level of 0. Again, the predicted log-gain and the long-term mean value of log-gain are subtracted from this default level of 0, and the resulting value is used to update the newest memory location for the log-gain predictor.

If the frame erasure lasts more than 20 ms but does not exceed 60 ms, then updating the predictor memory for the predictive gain quantizer may be challenging, because the extrapolated speech waveform is attenuated using the waveform attenuation window of FIG. 3. The log-gain predictor memory is updated based on the log-gain value of the waveform attenuation window in each frame.

To minimize the code size, for each of the frames from the fifth to the twelfth frames into frame erasure, a correction factor is calculated from the log-gain of the last frame based on the attenuation window of FIG. 3, and the correction factor is stored. The following algorithm calculates these 8 correction factors, or log-gain attenuation factors.

1. Initialize lastlg=0. (lastlg=last log-gain=log-gain of the last frame)
2. Initialize j=1.
3. Calculate the normalized attenuation window array $$w(n) = 1 - \frac{n-1}{(9-j)N_f},$$

n−1, 2, . . . , $N_f$.

4. Calculate $$lg = 2\log_2\left[\frac{1}{N_f}\sum_{n=1}^{N_f} w^2(n)\right]$$

5. Calculate lga(j)=lastlg−lg
6. If j<8, then set $$lastlg = lg - 2\log_2\left(\frac{8-j}{9-j}\right)$$

7. If j=8, stop; otherwise, increment j by 1 (i.e., j←j+1), then go back to step 3.

Basically, the above algorithm calculates the base-2 log-gain value of the waveform attenuation window for a given frame, and then determines the difference between this value and a similarly calculated log-gain for the window of the previous frame, compensated for the normalization of the start of the window to unity for each frame. The output of this algorithm is the array of log-gain attenuation factors lga(j) for j=1, 2, . . . , 8. Note that lga(j) corresponds to the (4+j)-th frame into frame erasure.

Once the lga(j) array has been pre-calculated and stored, then the log-gain predictor memory update for frame erasure lasting 20 ms to 60 ms becomes straightforward. If the current erased frame is the j-th frame into frame erasure (4<j≦12), lga(j−4) is subtracted from the log-gain value of the last frame. From the result of this subtraction, the predicted log-gain and the long-term mean value of log-gain are further subtracted, and the resulting value is used to update the newest memory location for the log-gain predictor.

After the module 211 calculates all the updated filter memory values, the decoder 100 uses these values to update the memories and of its short-term synthesis filter 190, long-term synthesis filter 180, LSP predictor, and gain predictor, in preparation for the decoding of the next frame, assuming the next frame will be received intact.

The frame erasure concealment scheme described above can be used as is, and it will provide significant speech quality improvement compared with applying no concealment. So far, essentially all the frame erasure concealment operations are performed during erased frames. The present invention has an optional feature that improves speech quality by performing "filter memory correction" at the first received good frame after the erasure.

The short-term synthesis filter memory and the long-term synthesis filter memory are updated in the module 211 based on waveform extrapolation. After the frame erasure is over, at the first received good frame after the erasure, there will be a mismatch between such filter memory in the decoder and the corresponding filter memory in the encoder. Very often the difference is mainly due to the difference between the pitch period (or time lag) used for waveform extrapolation during erased frame and the pitch period transmitted by the encoder. Such filter memory mismatch often causes audible distortion even after the frame erasure is over.

During erased frames, the pitch period is typically held constant or nearly constant. If the pitch period is instantaneously quantized (i.e. without using inter-frame predictive coding), and if the frame erasure occurs in a voiced speech segment with a smooth pitch contour, then, linearly interpolating between the transmitted pitch periods of the last good frame before erasure and the first good frame after erasure often provides a better approximation of the transmitted pitch period contour than holding the pitch period constant during erased frames. Therefore, if the synthesis filter memory is re-calculated or corrected at the first good frame after erasure, based on linearly interpolated pitch period over the erased frames, better speech quality can often be obtained.

The long-term synthesis filter memory is corrected in the following way at the first good frame after the erasure. First, the received pitch period at the first good frame and the received pitch period at the last good frame before the erasure are used to perform linear interpolation of the pitch period over the erased frames. If an interpolated pitch period is not an integer, it is rounded off to the nearest integer. Next, starting with the first erased frame, and then going through all erased from in sequence, the long-term synthesis filter memory is "re-extrapolated" frame-by-frame based on the linearly interpolated pitch period in each erased frame, until the end of the last erased frame is reached. For simplicity, a scaling factor of 1 may be used for the extrapolation of the long-term synthesis filter. After such re-extrapolation, the long-term synthesis filter memory is corrected.

The short-term synthesis filter memory may be corrected in a similar way, by re-extrapolating the speech waveform frame-by-frame, until the end of the last erased frame is reached. Then, the last M samples of the re-extrapolated speech waveform at the last erased frame, with the order reversed, will be the corrected short-term synthesis filter memory.

Another simpler way to correct the short-term synthesis filter memory is to estimate the waveform offset between the original extrapolated waveform and the re-extrapolated waveform, without doing the re-extrapolation. This method is described below. First, "project" the last speech sample of the last erased frame backward by ppfe1 samples, where ppfe1 is the original time lag used for extrapolation at that frame, and depending on which frame the newly projected sample lands, it is backward projected by the ppfe1 of that frame again. This process is continued until a newly projected sample lands on a good frame before the erasure. Then, using the linearly interpolated pitch period, a similar backward projection operation is performed until a newly projected sample lands on a good frame before the erasure. The distance between the two landing points in the good frame, obtained by the two backward projection operations above, is the waveform offset at the end of the last erased frame.

If this waveform offset indicates that the re-extrapolated speech waveform based on interpolated pitch period is delayed by X samples relative to the original extrapolated speech waveform at the end of the last erased frame, then the short-term synthesis filter memory can be corrected by taking the M consecutive samples of the original extrapolated speech waveform that are X samples away from the end of the last erased frame, and then reversing the order. If, on the other hand, the waveform offset calculated above indicates that the original extrapolated speech waveform is delayed by X samples relative to the re-extrapolated speech waveform (if such re-extrapolation were ever done), then the short-term synthesis filter memory correction would need to use certain speech samples that are not extrapolated yet. In this case, the original extrapolation for X more samples can be extended, and the last M samples can be taken with their order reversed. Alternatively, the system can move back one pitch cycle, and use the M consecutive samples (with order reversed) of the original extrapolated speech waveform that are (ppfe1−X) samples away from the end of the last erased frame, where ppfe1 is the time lag used for original extrapolation of the last erased frame, and assuming ppfe1>X.

One potential issue of such filter memory correction is that the re-extrapolation generally results in a waveform shift or offset; therefore, upon decoding the first good frame after an erasure, there may be a waveform discontinuity at the beginning of the frame. This problem can be eliminated if an output buffer is maintained, and the waveform shift is not immediately played out, but is slowly introduced, possibly over many frames, by inserting or deleting only one sample at a time over a long period of time. Another possibility is to use time scaling techniques, which are well known in the art, to speed up or slow down the speech slightly, until the waveform offset is eliminated. Either way, the waveform discontinuity can be avoided by smoothing out waveform offset over time.

If the additional complexity of such time scaling or gradual elimination of waveform offset is undesirable, a simpler, but sub-optimal approach is outlined below. First, before the synthesis filter memory is corrected, the first good frame after an erasure is decoded normally for the first Y samples of the speech. Next, the synthesis filter memory is corrected, and the entire first good frame after the erasure is decoded again. Overlap-add over the first Y samples is then used to provide a smooth transition between these two decoded speech signals in the current frame. This simple approach will smooth out waveform discontinuity if the waveform offset mentioned above is not excessive. If the waveform offset is too large, then this overlap-add method may not be able to eliminate the audible glitch at the beginning of the first good frame after an erasure. In this case, it is better not to correct the synthesis filter memory unless the time scaling or gradual elimination of waveform offset mentioned above can be used.

Figure 4:
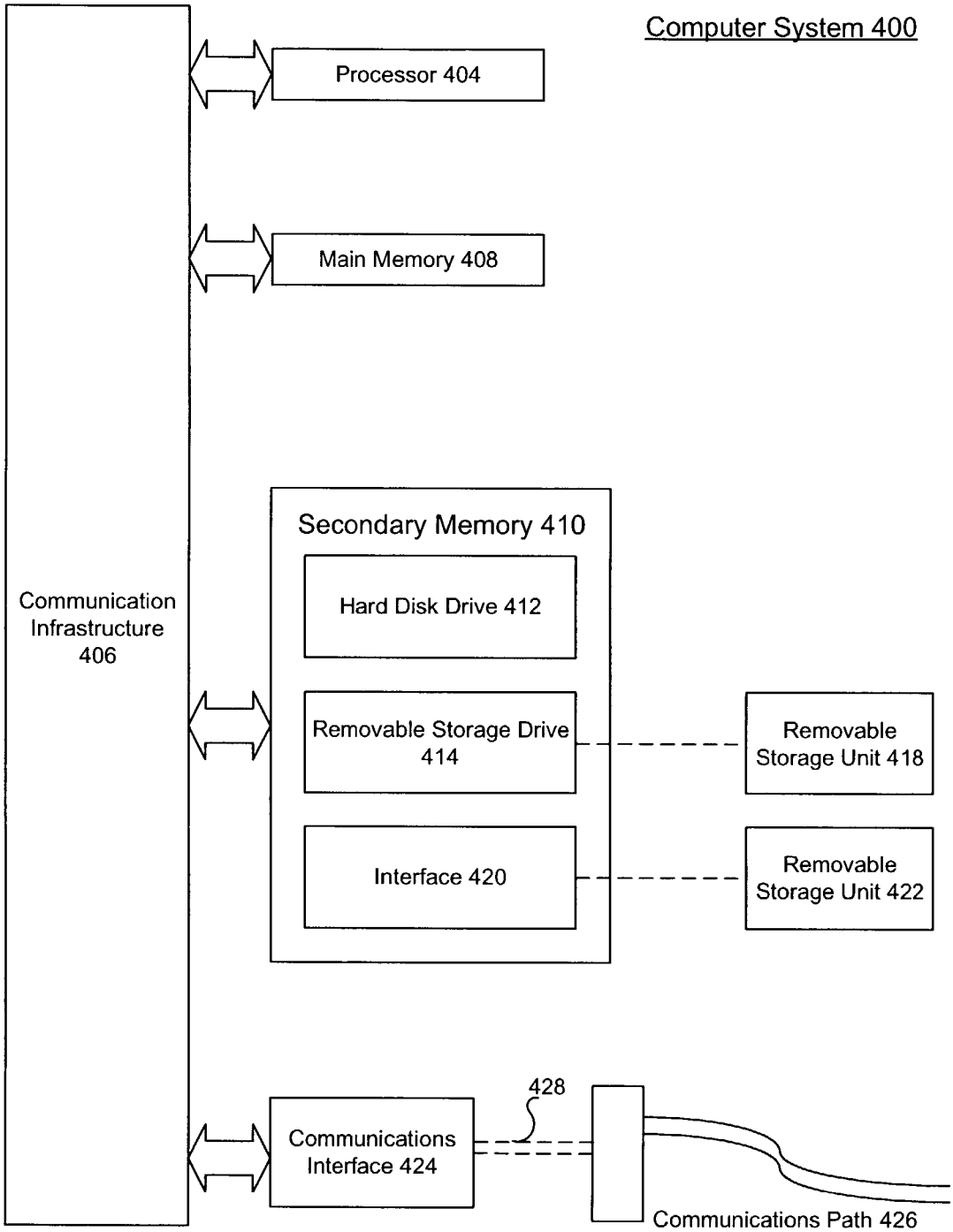
FIG. 4 is a block diagram of an exemplary computer system on which the present invention can be practiced.

The following description of a general purpose computer system is provided for completeness. As stated above, the present invention can be implemented in hardware, or as a combination of software and hardware. Consequently, the invention may be implemented in the environment of a computer system or other processing system. An example of such a computer system 400 is shown in FIG. 4. In the present invention, all of the elements depicted in FIGS. 1 and 2, for example, can execute on one or more distinct computer systems 400, to implement the various methods of the present invention.

The computer system 400 includes one or more processors, such as a processor 404. The processor 404 can be a special purpose or a general purpose digital signal processor and it's connected to a communication infrastructure 406 (for example, a bus or network). Various software implementations are described in terms of this exemplary computer system. After reading this description, it will become apparent to a person skilled in the relevant art how to implement the invention using other computer systems and/or computer architectures.

The computer system 400 also includes a main memory 408, preferably random access memory (RAM), and may also include a secondary memory 410. The secondary memory 410 may include, for example, a hard disk drive 412 and/or a removable storage drive 414, representing a floppy disk drive, a magnetic tape drive, an optical disk drive, etc. The removable storage drive 414 reads from and/or writes to a removable storage unit 418 in a well known manner. The removable storage unit 418, represents a floppy disk, magnetic tape, optical disk, etc. which is read by and written to by removable storage drive 414. As will be appreciated, the removable storage unit 418 includes a computer usable storage medium having stored therein computer software and/or data.

In alternative implementations, the secondary memory 410 may include other similar means for allowing computer programs or other instructions to be loaded into the computer system 400. Such means may include, for example, a removable storage unit 422 and an interface 420. Examples of such means may include a program cartridge and cartridge interface (such as that found in video game devices), a removable memory chip (such as an EPROM, or PROM) and associated socket, and the other removable storage units 422 and the interfaces 420 which allow software and data to be transferred from the removable storage unit 422 to the computer system 400.

The computer system 400 may also include a communications interface 424. The communications interface 424 allows software and data to be transferred between the computer system 400 and external devices. Examples of the communications interface 424 may include a modem, a network interface (such as an Ethernet card), a communications port, a PCMCIA slot and card, etc. Software and data transferred via the communications interface 424 are in the form of signals 428 which may be electronic, electromagnetic, optical or other signals capable of being received by the communications interface 424. These signals 428 are provided to the communications interface 424 via a communications path 426. The communications path 426 carries the signals 428 and may be implemented using wire or cable, fiber optics, a phone line, a cellular phone link, an RF link and other communications channels.

In the present application, the terms "computer readable medium" and "computer usable medium" are used to generally refer to media such as the removable storage drive 414, a hard disk installed in the hard disk drive 412, and the signals 428. These computer program products are means for providing software to the computer system 400.

Computer programs (also called computer control logic) are stored in the main memory 408 and/or the secondary memory 410. Computer programs may also be received via the communications interface 424. Such computer programs, when executed, enable the computer system 400 to implement the present invention as discussed herein.

In particular, the computer programs, when executed, enable the processor 404 to implement the processes of the present invention. Accordingly, such computer programs represent controllers of the computer system 400. By way of example, in the embodiments of the invention, the processes/methods performed by signal processing blocks of encoders and/or decoders can be performed by computer control logic.

Where the invention is implemented using software, the software may be stored in a computer program product and loaded into the computer system 400 using the removable storage drive 414, the hard drive 412 or the communications interface 424.

In another embodiment, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

The foregoing description of the preferred embodiments provide an illustration and description, but is not intended to be exhaustive or to limit the invention to the precise form disclosed. Modifications and variations are possible consistent with the above teachings, or may be acquired from practice of the invention.

The invention claimed is:

1. A method of synthesizing a number of corrupted frames output from a decoder including one or more predictive filters, the corrupted frames being representative of one segment of a decoded signal (sq(n)) output from the decoder, the method comprising:

determining, using at least one processor, a first preliminary time lag (ppfe1) based upon examining a predetermined number (K) of samples of another segment of the decoded signal;

determining, using the at least one processor, a scaling factor (ptfe) associated with the examined number (K) of samples, the scaling factor (ptfe) only being a function of (i) the first preliminary time lag (ppfe1) and (ii) the decoded signal (sq(n)); and extrapolating, using the at least one processor, a first replacement frame based upon the first preliminary time lag (ppfe1) and the scaling factor (ptfe).

2. The method of claim 1, further comprising updating internal states of the filters based upon the extrapolating.

3. The method of claim 2, wherein the examined number (K) of samples is selected from within a number (N) of stored samples;

wherein correlation values (c(j)) associated with candidate preliminary time lags (j) are determined in accordance with the expression:

$$c(j) = \sum_{n=N-K+1}^{N} sq(n)sq(n-j);$$

and wherein the first preliminary time lag (ppfe1) is chosen from within the candidate preliminary time lags (j) and maximizes the expression:

$$nc(j) = \frac{\left(\sum_{n=N-K+1}^{N} sq(n)sq(n-j)\right)^2}{\sum_{n=N-K+1}^{N} sq^2(n-j)}.$$

4. The method of claim 3, wherein the scaling factor (ptfe) is determined in accordance with the expression:

$$ptfe1 = sign[c(ppfe1)] \times \frac{\sum_{n=N-K+1}^{N} |sq(n)|}{\sum_{n=N-K+1}^{N} |sq(n-ppfe1)|}.$$

5. The method of claim 4, further comprising examining the first preliminary lag (ppfe1) when (i) the number of frames includes consecutively corrupted frames and (ii) a second of the number of consecutively corrupted frames is received;

wherein the other segment includes a last received good frame immediately preceding a first of the number of consecutively corrupted frames.

6. The method of claim 5, wherein the examining includes comparing the first preliminary time lag (ppfe1) with other time lags respectively associated with other received good frames, the other good frames immediately preceding the last received good frame.

7. The method of claim 5, further comprising modifying the first preliminary time lag (ppfe1) based upon the comparing if a change between the first preliminary time lag (ppfe1) and the other time lags exceeds a predetermined amount.

8. The method of claim 7, wherein the predetermined amount is within about five percent and is based upon a change between the first preliminary time lag (ppfe1) and each of the other time lags.

9. The method of claim 8, wherein the other received good frames include up to four frames.

10. The method of claim 9, wherein the modifying further includes (i) determining a pitch change per frame, (ii) rounding the determined pitch change per frame to a nearest integer value, (iii) adding the integer value to the first preliminary time lag (ppfe1) to produce an adjusted first preliminary time lag (ppfe1).

11. The method of claim 10, further comprising performing a first waveform extrapolation to extrapolate the at least one of the subsequent replacement frames based upon the adjusted first preliminary time lag (ppfe1) and the scaling factor (ptfe).

12. The method of claim 1, further comprising determining a periodic extrapolation flag (pwef) for the examined predetermined number (K) of samples.

13. The method of claim 12, wherein the determining the extrapolation flag (pwef) includes calculating (i) a normalized logarithmic signal gain (nlg), (ii) a pitch prediction gain (ppg), and a (iii) first normalized autocorrelation coefficient ($\rho_1$), the normalized logarithmic signal gain, the pitch prediction gain, and the normalized autocorrelation coefficient being associated with the decoded signal.

14. The method of claim 13, wherein the determining of the extrapolation flag (pwef) further includes (i) calculating a weighted sum of the normalized logarithmic signal gain, the pitch prediction gain, and the normalized autocorrelation coefficient, and (ii) comparing the calculated weighted sum with a predetermined threshold;

wherein if the weighted sum exceeds the predetermined threshold, the periodic extrapolation flag (pwef) is set to a first value; and wherein is the weighted sum does not exceed the predetermined threshold, the periodic extrapolation flag is set to a second value.

15. The method of claim 14, wherein the first value is one and the second value is zero.

16. The method of claim 15, wherein the examining the predetermined number of samples of the other segment is performed in accordance with an analysis window; and wherein an amount of energy (E) within the analysis window in determined in accordance with the expression:

$$E = \sum_{n=N-K+1}^{N} sq^2(n).$$

17. The method of claim 16, wherein lg is the base-2 logarithmic gain of the decoded signal (sq(n)); and wherein if the amount of energy (E) is greater than zero, then the base-2 logarithmic gain lg equals $\log_2 E$.

18. The method of claim 17, wherein the determining of the normalized logarithmic signal gain (nlg) includes determining a long term average (lvl) of the logarithmic gain of an active portion of the decoded signal (sq(n)); and wherein the normalized logarithmic signal gain (nlg) is determined in accordance with the equation:

$$nlg = lg - lvl.$$

19. The method of claim 18, wherein the calculating the pitch prediction gain (ppg) is determined in accordance with the expression:

$$ppg = 10\log_{10}\left(\frac{E}{R}\right),$$

where $$R = E - \frac{c^2(ppfe1)}{\sum_{n=N-K+1}^{N} sq^2(n-ppfe1)}.$$

20. The method of claim 19, wherein the calculating of the first normalized autocorrelation coefficient($\rho_1$) is determined in accordance with the expression:

$$\rho_1 = \frac{\sum_{n=N-K+2}^{N} sq(n)sq(n-1)}{E}.$$

21. The method of claim 20, wherein the a normalized logarithmic signal gain (nlg), the pitch prediction gain (ppg), and the first normalized autocorrelation coefficient($\rho_1$) combine to form a single figure of merit (fom) representative of the decoded signal (sq(n)), the single figure of merit (fom) being determined in accordance with the normalized logarithmic signal gain (nlg), the pitch prediction gain (ppg), and the first normalized autocorrelation coefficient($\rho_1$); and wherein a status of the periodic extrapolation flag (pwef) is based upon the figure of merit (fom).

22. The method of claim 21 wherein figure of merit (fom) is determined in accordance with the expression:

$$fom = nlg + 1.25ppg + 16\rho_1.$$

23. The method of claim 22, further comprising searching for a second time lag (ppfe2) if (i) the periodic extrapolation flag (pwef) is a predetermined value and (ii) the first preliminary time lag (ppfe1) is less than a predetermined amount, the second time lag (ppfe2) being based upon the first time lag (ppfe1);

wherein the second time lag (ppfe2) is greater than or equal to the predetermined amount.

24. The method of claim 23, wherein the second time lag (ppfe2) maximizes the expression:

$$cor(j) = \sum_{n=N-N_f+1}^{N} sq(n)sq(n-j);$$

where ($N_f$) is the number of samples within a frame.

25. The method of claim 23, further comprising performing a second waveform extrapolation to extrapolate the at least one of the subsequent replacement frames based upon the second time lag (ppfe2).

26. The method of claim 25, wherein the at least one of the subsequent replacement frames is defined by the expression:

$$sq_2(n) = \begin{cases} sq(n-ppfe2), & \text{for } n = N+1, \ldots, N+N_f, \text{ if } pwef = 0 \text{ and } ppfe1 < T_0 \\ 0, & \text{for } n = N+1, \ldots, N+N_f, \text{ if } pwef \neq 0 \text{ and } ppfe1 \geq T_0 \end{cases}$$

where $T_0$ is the number of samples corresponding to a predetermined amount of time.

27. The method of claim 26, wherein the predetermined amount of time is about ten milliseconds.

28. The method of claim 27, further comprising determining sample magnitudes of the first preliminary time lag (ppfe1) and the second time lag (ppfe2).

29. The method of claim 28, wherein the sample magnitudes of the first preliminary time lag (ppfe1) and the second time lag (ppfe2) are respectively determined in accordance with the expressions:

$$sum1 = \sum_{n=N+1}^{N+N_f} |sq(n)|$$

$$sum2 = \sum_{n=N+1}^{N+N_f} |sq_2(n)|.$$

30. The method of claim 29, wherein the waveforms sq(n) and $sq_2(n)$ are combined in accordance with the expression:

$$sq(n) \leftarrow sq(n) + sq_2(n), \text{ for } n = N+1, N+2, \ldots, N+N_f$$

where sq(n) is replaced by the sum of sq(n) and $sq_2(n)$.

31. The method of claim 30, further comprising summing sample magnitudes of sq(n) in accordance with the expression:

$$sum3 = \sum_{n=N+1}^{N+N_f} |sq(n)|.$$

32. The method of claim 31, further comprising scaling the summed waveform.

33. A method of synthesizing a number of corrupted frames output from a decoder including one or more predictive filters, the corrupted frames being representative of one segment of a decoded signal (sq(n)) output from the decoder, the method comprising:

determining, using at least one processor, a first preliminary time lag (ppfe1) based upon examining a predetermined number (K) of samples of another segment of the decoded signal;

determining, using the at least one processor, a scaling factor (ptfe) associated with the examined number (K) of samples, the scaling factor (ptfe) only being a function of (i) the first preliminary time lag (ppfe1) and (ii) the decoded signal (sq(n));

extrapolating, using the at least one processor, a first replacement frame based at least upon the first preliminary time lag (ppfe1) and the scaling factor (ptfe);

wherein subsequent replacement frames are extrapolated based upon a time lag and scaling factor found in the first replacement frame; and correcting, using the at least one processor, internal states of the filters when a first good frame is received, the first good frame being received after the number of corrupted frames.

34. The method of claim 33, wherein the updating includes updating short-term and long-term synthesis filters associated with the one or more predictive filters.

35. The method of claim 34, wherein the updating of the short-term predictive filter is performed in accordance with the expression:

$$stsm(k) = sq(N+N_f+1-k), k = 1, 2, \ldots, M.$$

wherein, stsm(k) represents the k-th memory value of a short-term synthesis filter associated with the short-term predictive filters;

(M) represents the last M samples of the one segment of the decoded signal;

(N) represents the number of decoder output speech samples in previous frames that are stored; and $N_f$ represent the number of samples in a frame.

36. The method of claim 35, wherein the updating of the long-term synthesis filter includes updating content of an internal memory and extrapolating a predetermined number of samples (L) of a first of the replacement frames in accordance with the expression:

$$ltsm(n) = ptfe1 \times ltsm(n-ppfe1), \text{ for } n = N+1, N+2, \ldots, N+L.$$

37. The method of claim 36, wherein the updating further includes overlap-adding the content of the internal memory with a ringing of the long-term synthesis filter in accordance with the expression:

$$ltsm(N+n) \leftarrow w_u(n)ltsm(N+n) + w_d(n)ltr(n), \quad \text{for} \quad n = 1, 2, \ldots, L;$$

where $w_u$ represents a windowing function associated with the first of the replacement waveforms.

38. An apparatus for synthesizing a number of corrupted frames output from a decoder including one or more predictive filters, the corrupted frames being representative of one segment of a decoded signal (sq(n)) output from the decoder, the apparatus comprising:

at least one processor;

means for determining, using the at least one processor, a first preliminary time lag (ppfe1) based upon examining a predetermined number (K) of samples of another segment of the decoded signal;

means for determining, using the at least one processor, a scaling factor (ptfe) associated with the examined number (K) of samples, the scaling factor (ptfe) only being a function of (i) the first preliminary time lag (ppfe1) and (ii) the decoded signal (sq(n)); and means for extrapolating, using the at least one processor, a first replacement frame based upon the first preliminary time lag (ppfe1) and the scaling factor (ptfe).

39. The apparatus of claim 38, further comprising means for updating internal states of the filters based upon the extrapolating.

40. An apparatus for synthesizing a number of corrupted frames output from a decoder including one or more predictive filters, the corrupted frames being representative of one segment of a decoded signal (sq(n)) output from the decoder, the apparatus comprising:

at least one processor;

means for determining, using the at least one processor, a first preliminary time lag (ppfe1) based upon examining a predetermined number (K) of samples of another segment of the decoded signal;

means for determining, using the at least one processor, a scaling factor (ptfe) associated with the examined number (K) of samples, the scaling factor (ptfe) only being a function of (i) the first preliminary time lag (ppfe1) and (ii) the decoded signal (sq(n));

means for extrapolating, using the at least one processor, a first replacement frame based at least upon the first preliminary time lag (ppfe1) and the scaling factor (ptfe);

wherein subsequent replacement frames are extrapolated based upon a time lag and scaling factor found in the first replacement frame; and means for correcting, using the at least one processor, internal states of the filters when a first good frame is received, the first good frame being received after the number of corrupted frames.

41. The apparatus of claim 40, wherein the updating includes updating short-term and long-term synthesis filters associated with the one or more predictive filters.

42. A computer usable storage medium carrying one or more sequences of one or more instructions for execution by one or more processors to perform a method of synthesizing a number of corrupted frames output from a decoder including one or more predictive filters, the corrupted frames being representative of one segment of a decoded signal (sq(n)) output from the decoder, the instructions when executed by the one or more processors, cause the one or more processors to perform the steps of:

determining a first preliminary time lag (ppfe1) based upon examining a predetermined number (K) of samples of another segment of the decoded signal;

determining a scaling factor (ptfe) associated with the examined number (K) of samples, the scaling factor (ptfe) only being a function of (i) the first preliminary time lag (ppfe1) and (ii) the decoded signal (sq(n)); and extrapolating a first replacement frame based upon the first preliminary time lag (ppfe1) and the scaling factor (ptfe);

wherein subsequent replacement frames are extrapolated based upon a time lag and scaling factor found in the first replacement frame.

43. The computer usable storage medium of claim 42, further causing the one or more processors to update internal states of the filters based upon the extrapolating.

44. A computer usable storage medium carrying one or more sequences of one or more instructions for execution by one or more processors to perform a method for synthesizing a number of corrupted frames output from a decoder including one or more predictive filters, the corrupted frames being representative of one segment of a decoded signal (sq(n)) output from the decoder, the instructions when executed by the one or more processors, cause the one or more processors to perform the steps of:

determining a first preliminary time lag (ppfe1) based upon examining a predetermined number (K) of samples of another segment of the decoded signal;

determining a scaling factor (ptfe) associated with the examined number (K) of samples, the scaling factor (ptfe) only being a function of (i) the first preliminary time lag (ppfe1) and (ii) the decoded signal (sq(n));

extrapolating a first replacement frame based at least upon the first preliminary time lag (ppfe1) and the scaling factor (ptfe);

wherein subsequent replacement frames are extrapolated based upon a time lag and scaling factor found in the first replacement frame; and correcting internal states of the filters when a first good frame is received, the first good frame being received after the number of corrupted frames.

45. The computer usable storage medium of claim 44, wherein the updating includes updating short-term and long-term synthesis filters associated with the one or more predictive filters.

* * * * *

UNITED STATES PATENT AND TRADEMARK OFFICE

CERTIFICATE OF CORRECTION

PATENT NO. : 7,590,525 B2
APPLICATION NO. : 10/222934
DATED : September 15, 2009
INVENTOR(S) : Juin-Hwey Chen It is certified that error appears in the above-identified patent and that said Letters Patent is hereby corrected as shown below:

In Column 21, line 65, "wherein is the weighted sum" should be --wherein if the weighted sum--;

In Column 22, line 3, "wherein the examining the" should be --wherein examining the--;

In Column 22, line 26, "wherein the calculating the" should be --wherein calculating the--; and In Column 22, line 50, "wherein the a normalized" should be --wherein the normalized--.

Signed and Sealed this

Tenth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,590,525 B2
APPLICATION NO. : 10/222934
DATED : September 15, 2009
INVENTOR(S) : Juin-Hwey Chen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 964 days.

Signed and Sealed this

Twenty-first Day of September, 2010

David J. Kappos

David J. Kappos
*Director of the United States Patent and Trademark Office*